United States Patent [19]

Araki et al.

[11] Patent Number: 4,576,635

[45] Date of Patent: Mar. 18, 1986

[54] PROCESS FOR PRODUCING FERROMAGNETIC METAL POWDER

[75] Inventors: Hiroaki Araki; Tatsuji Kitamoto, both of Odawara, Japan

[73] Assignee: Fuji Photo Film Co., Ltd., Kanagawa, Japan

[21] Appl. No.: 705,975

[22] Filed: Feb. 27, 1985

[30] Foreign Application Priority Data

Feb. 27, 1984 [JP] Japan ..... 59-35582

[51] Int. Cl.[4] ..... B22F 1/02; H01F 1/33

[52] U.S. Cl. ..... 75/0.5 AA; 148/105

[58] Field of Search ..... 75/0.5 AA; 148/105

[56] References Cited

U.S. PATENT DOCUMENTS

| | | | |
|---|---|---|---|
| 4,133,677 | 1/1979 | Matsui et al. | 148/105 |
| 4,406,694 | 9/1983 | Mishima et al. | 148/105 |
| 4,439,231 | 3/1984 | Steck et al. | 148/105 |
| 4,456,475 | 6/1984 | Hirai et al. | 75/0.5 AA |
| 4,514,216 | 4/1985 | Mishima et al. | 75/0.5 AA |

*Primary Examiner*—Wayland Stallard

*Attorney, Agent, or Firm*—Toren, McGeady, Stanger, Goldberg & Kiel

[57] ABSTRACT

A process for producing a ferromagnetic metal powder comprising treating acicular iron oxyhydroxide or an acicular metal oxyhydroxide composed mainly of iron with a silicon compound, dehydrating the treated material by heating the material in a non-reducing atmosphere to produce iron oxide particles or metal oxide particles composed mainly of iron, and reducing the resulting iron oxide particles or metal oxide particles composed mainly of iron by heating in a reducing atmosphere to produce iron powder or a metal powder composed mainly of iron, which is characterized in that the dehydration by heating in a non-reducing atmosphere is carried out at a temperature of from 300° to 800° C. and the iron oxide particles or the metal oxide particles composed mainly of iron are treated with a silicon compound prior to reduction by the heating in a reducing atmosphere.

7 Claims, No Drawings

PROCESS FOR PRODUCING FERROMAGNETIC METAL POWDER

BACKGROUND OF THE INVENTION

1. Field of the Invention

The present invention relates to a process for producing a ferromagnetic metal powder.

2. Description of Prior Arts

In recent years there have been extensively studied and developed magnetic recording media such as magnetic tapes using a ferromagnetic metal powder which is a magnetic substance having a high coercive force (Hc) and high saturation magnetization ($\sigma s$) for the purpose of improving the recording density and reproducing output.

As one of processes for producing a ferromagnetic metal powder for use in magnetic recording media, there is known a process wherein acicular iron oxyhydroxide or an acicular metal oxyhydroxide composed mainly of iron is dehydrated by heating in a non-reducing atmosphere to produce iron oxide particles or metal oxide particles and the resulting iron oxide or metal oxide particles are then reduced by heating in a reducing atmosphere.

It is known that the above-stated process for producing the ferromagnetic metal powder has disadvantages, particularly a problem in that since the reduction in the above process is carried out by heating in a hydrogen stream atmosphere, the powder is liable to sinter in the course of the reduction. It is known that the coercive force of the metal powder depends mainly on anisotropy in shape defined by the acicular nature of particles so that it is important to retain the acicular nature of the material.

In order to avoid sintering in the course of the reduction by heating, heretofore, there has been employed a process wherein the starting material (i.e., acicular oxyhydroxide) is previously treated with a compound having an effect of inhibition of sintering (i.e., sintering inhibitor) to have the sintering inhibitor deposited or adsorbed on the surface of the material, and the treated oxyhydroxide is dehydrated by heating in a non-reducing atmosphere and then reduced by heating in a reducing atmosphere. As the sintering inhibitor, silicon compounds are disclosed in, for example, Japanese Patent Provisional Publication Nos. 52(1977)-134858, 56(1981)-156706 and 57(1982)-63605.

SUMMARY OF THE INVENTION

It has been now found that a certain amount of the silicon compound serving as the sintering inhibitor deposited or adsorbed on the oxyhydroxide is liable to be incorporated into the oxyhydride in the course of the heating dehydration treatment in the above-described process, and as a result, the shape retention effect tends to diminish. Accordingly, the resulting metal powder is liable to degrade in the shape and at the same time the crystal size in the metal powder increases and the specific surface area is reduced. When the crystal size increases (which means that the specific surface area decreases), the noise level of signals generated by the magnetic recording medium using such a ferromagnetic metal powder is raised. For this reason, the decrease in the specific surface area of the ferromagnetic powder is not preferred.

It is an object of the invention to provide a ferromagnetic metal powder having well acceptable acicular nature.

It is another object of the invention to provide a ferromagnetic metal powder having a large specific surface area.

The present inventors have made studies to attain the above-mentioned object and discovered a method capable of avoiding the sintering and obtaining a ferromagnetic metal powder having a large specific surface area without degradation of the acicular nature of the oxide.

Accordingly, the present invention provides a process for producing a ferromagnetic metal powder comprising treating acicular iron oxyhydroxide or an acicular metal oxyhydroxide composed mainly of iron with a silicon compound, dehydrating the treated material by heating in a non-reducing atmosphere to produce iron oxide particles or metal oxide particles composed mainly of iron, and reducing the resulting iron oxide particles or metal oxide particles composed mainly of iron by heating in a reducing atmosphere to produce iron powder or a metal powder composed mainly of iron, characterized in that the dehydration by heating in a non-reducing atmosphere is carried out at a temperature of from 300° to 800° C. and the iron oxide particles or the metal oxide particles composed mainly of iron are treated with a silicon compound prior to the reduction by heating in a reducing atmosphere.

DETAILED DESCRIPTION OF THE INVENTION

The acicular iron oxyhydroxide which is used as a starting material in the invention can be obtained by a conventional method, for example, by neutralizing an aqueous solution of a ferrous salt or a mixture of a ferrous salt and a ferric salt with an alkali and then oxidizing the resultant in an oxidizing gas. If desired, other element other than iron(Fe), such as titanium(Ti), vanadium(V), chromium(Cr), manganese(Mn), cobalt(Co), nickel(Ni), copper(Cu), zinc(Zn), silicon(Si), phosphorus(P), molybdenum(Mo), tin(Sn), antimony(Sb) or silver(Ag) may be added before, during or after the reaction to obtain an acicular metal oxyhydroxide composed mainly of iron. Such elements may be added either alone or as a mixture of two or more of them. Preferably, the particle of the acicular iron oxyhydroxide (hereinafter, this term means both the acicular iron oxyhydroxide and the acicular metal oxyhydroxide composed mainly of iron, unless otherwise stated) powder used in the present invention has a shape such that the length is from 0.1 to 2 $\mu$m and the acicular ratio (aspect ratio) is from 2/1 to 50/1.

In performing the present invention, the acicular iron oxyhydroxide is first treated with a silicon compound to have the silicon compound deposited or adsorbed on the surface of the acicular iron oxyhydroxide. The preferred amount of the silicon compound to be employed for the treatment (i.e., the amount of Si to be deposited or adsorbed) is from 0.5 to 15% in terms of Si/Fe ratio (atomic ratio). The optimum amount of the silicon compound varies depending on the nature of the starting iron oxyhydroxide and the specific surface area thereof. If the amount of Si to be deposited or adsorbed in the first silicon compound-treating stage is too small, the resulting particles are liable to sinter during the subsequent heating dehydration stage. If the sintering takes place, the highly acicular nature of the starting iron oxyhydroxide is not left in the particles of the intermediate iron oxide (hereinafter this term means both iron oxide and the metal oxide composed mainly of iron, unless otherwise stated), and the final product (i.e., ferromagnetic metal powder composed mainly of iron) becomes poor in the acicular nature. On the other hand, if the amount of Si to be deposited or adsorbed in the first treating stage is too large, a considerable amount of silicon is incorporated in the interior of the particle in the course of the heating dehydration stage. Therefore the reduction is liable to be highly suppressed in the course of the heating reduction stage, resulting in the formation of a ferromagnetic metal powder exhibiting low saturation magnetization.

In the subsequent stage, the silicon compound-treated iron oxyhydroxide is dehydrated by heating at a temperature of from 300° to 800° C. in a non-reducing gas atmosphere to convert it to an iron oxide powder. Generally, the iron oxyhydroxide is dehydrated at a temperature of about 250° C. or higher. As the non-reducing gas, any of inert gases such as nitrogen and an oxidizing gas such as air can be used.

The specific surface area of the iron oxide particle obtained by the heating dehydration varies with the temperature at which the heating dehydration is carried out. The lower the temperature, the larger the specific surface area, and hence, highly porous particles are formed. However, in the low temperature process, the resulting particles deteriorate in the crystalline nature so that sintering is liable to take place in the subsequent heating reduction treatment, the resulting ferromagnetic metal powder becomes poor in the acicular nature and magnetic characteristics deteriorate. On the other hand, if the temperature of the heating dehydration is too high, the specific surface area of the produced iron oxide particle decreases, and hence the specific surface area of the ferromagnetic metal powder obtained by the subsequent heating reduction treatment also decreases. Thus, the effect expected in the process of the present invention cannot be obtained. For this reason, the dehydration temperature in the invention should be within the range of 300° to 800° C., preferably 400° to 650° C.

In the subsequent stage, the resulting iron oxide particles are treated with a silicon compound to have the silicon compound deposited or adsorbed on the surfaces of the particles. The amount of the silicon compound (the amount of Si to be deposited or adsorbed) is preferably from 0.5 to 15% in terms of Si/Fe ratio (atomic ratio). The optimum amount thereof varies depending on the nature of the starting oxyhydroxide and the specific surface area of iron oxide particle obtained by the dehydration treatment. It is necessary to increase the amount of the silicon compound with an increase in the specific surface area of the iron oxide particle.

The iron oxide powder obtained by a series of stages of treating the starting iron oxyhydroxide with a silicon compound, dehydrating the resulting silicon compound-treated iron oxyhydroxide under heating and then treating the resulting iron oxide particle again with a silicon compound, is then reduced by heating in a hydrogen stream at a temperature of from 300° to 550° C. to produce a ferromagnetic metal powder composed mainly of iron. A lower reduction temperature is preferred from the viewpoint of the suppression of sintering. However, if the reduction temperature is too low, the reduction proceeds too slowly and can not be completed within a practically applicable period of time. Generally, the treatment with a silicon compound has a tendency to interfere with reduction so that it is necessary to carry out the reduction at an elevated temperature. Thus, if the amount of the silicon compound used is excessively increased, a higher reduction temperature must be used which again poses a problem of sintering.

The inventors have further made studies to find out a process which is substantially free from the above-mentioned disadvantages, and have found that when nickel(Ni) or copper(Cu) is incorporated into the starting iron oxyhydroxide, it becomes possible to carry out the reduction even at a low temperature and the reduction readily proceeds with iron oxide treated with a large amount of a silicon compound. Thus, the effect of the present invention can be further improved. The preferred amount of Ni or Cu to be incorporated is from 1 to 20 atomic % (preferably, 3 to 20 atomic %) based on the amount of Fe in the starting iron oxyhydroxide. If the amount is lower than the lower limit specified above, the satisfactory effect can be hardly obtained, while if the amount exceeds that specified above, the saturation magnetization ($\sigma s$) of the resulting ferromagnetic metal powder is reduced. Preferably, the metal composed mainly of iron contains 1 to 20 atomic % of at least one metal selected from nickel and copper and the remainder is substantially iron.

The reason why the ferromagnetic metal powder having a good shape retention and a large specific surface area is obtained by the present invention as compared with the case utilizing the conventional process is thought to originate from the following fact:

In the conventional process, the silicon compound deposited (or adsorbed) on the surface of iron oxyhydroxide migrates into the interior of the resulting iron oxide and is dispersed therein, or a crystal of iron oxide is formed by the heating dehydration treatment. Therefore, there are formed fresh surfaces where the particles are not treated with the silicon compound. For this reason, the effect of preventing the particles from sintering during the subsequent reduction treatment is reduced. In the present invention, on the other hand, the starting material is first treated with a silicon compound, then the dehydration treatment is carried out and the resulting iron oxide is again treated with a silicon compound in such a manner that the silicone compound is deposited (or adsorbed) on the surface of the iron oxide. Accordingly, a remarkable effect of inhibition of sintering in both the dehydration and reduction stages can be obtained.

Therefore, the acicular shape of the starting iron oxyhydroxide (including the metal oxyhydroxide composed mainly of iron) can be kept intact to impart the acicular shape to the intermediate iron oxide powder and further to the final metal powder so that a metal powder which is highly acicular and has a larger specific surface area as compared with the conventional processes is obtained.

The following examples will further illustrate the present invention in more detail.

EXAMPLE 1

150 g. of $\alpha$-FeOOH powder having a length of 0.4 $\mu$m and an acicular ratio of 20 was suspended in 2 of water and there was then added with stirring an aqueous sodium silicate solution in a ratio of Si/Fe of 3 atomic %. Stirring was continued for additional one hour, and the resulting slurry was filtered. Thus obtained product was washed with water and dried to give a Si-coated $\alpha$-FeOOH powder. The Si-coated $\alpha$-FeOOH was then dehydrated by heating at 350° C. in a nitrogen stream for two hours to give an acicular $\alpha$-$Fe_2O_3$ powder.

100 g. of the $\alpha$-$Fe_2O_3$ powder was suspended in 2 l of water and to the resulting suspension was added with stirring an aqueous sodium silicate solution in a ratio of Si/Fe of 3 atomic %. Stirring was continued for additional one hour, and the resulting slurry was filtered. Thus collected product was washed with water and dried to give a Si-coated $\alpha$-$Fe_2O_3$ powder.

The Si-coated $\alpha$-$Fe_2O_3$ powder was then reduced in a hydrogen stream at 440° C. for six hours to obtain the desired ferromagnetic metal powder.

EXAMPLE 2

The procedure of Example 1 was repeated except that the dehydration treatment was performed at 500° C. to give $\alpha$-$Fe_2O_3$ powder and then a ferromagnetic metal powder.

EXAMPLE 3

The procedure of Example 1 was repeated except that the dehydration treatment was performed at 700° C. to give $\alpha$-$Fe_2O_3$ and then a ferromagnetic metal powder.

COMPARISON EXAMPLE 1

The procedure of Example 1 was repeated except that the dehydration treatment was performed at 850° C. to give $\alpha$-$Fe_2O_3$ powder and then a ferromagnetic metal powder.

COMPARISON EXAMPLE 2

150 g. of the same $\alpha$-FeOOH as that used in Example 1 was suspended in 2 l of water, and an aqueous sodium silicate solution in a ratio of Si/Fe of 6 atomic % was added thereto with stirring. Stirring was continued for additional one hour, and the resulting slurry was filtered. Thus obtained product was washed with water and dried. The resulting Si-coated $\alpha$-FeOOH powder was dehydrated by heating at 500° C. in a nitrogen stream to obtain a $\alpha$-$Fe_2O_2$ powder.

100 g. of thus obtained $\alpha$-$Fe_2O_3$ powder was reduced in a hydrogen stream at 440° C. for six hours to obtain a ferromagnetic metal powder.

COMPARISON EXAMPLE 3

150 g. of the same $\alpha$-FeOOH (coated with no silicon compound) as that used in Example 1 was dehydrated by heating at 500° C. in a nitrogen stream for two hours to obtain $\alpha$-$Fe_2O_3$ powder. 100 g. of this powder was suspended in 2 l of water, and an aqueous sodium silicate solution in a ratio of Si/Fe of 6 atomic % was added thereto with stirring. Stirring was continued for additional one hour, and the resulting slurry was filtered. Thus obtained product was washed with water and dried to give a Si-coated $\alpha$-$Fe_2O_3$ powder.

The $\alpha$-$Fe_2O_3$ powder was then reduced in a hydrogen stream at 440° C. for six hours to give a ferromagnetic metal powder.

EXAMPLE 4

150 g. of 5% Ni-doped $\alpha$-FeOOH powder having a length of 0.4 $\mu$m and an acicular ratio of 20 was suspended in 2 l of water, and to the resulting suspension was added with stirring an aqueous sodium silicate solution in a ratio of Si/Fe of 8 atomic %. Stirring was continued for additional one hour, and the resulting slurry was filtered. Thus collected product was washed with water and dried to give a Si-coated Ni-containing $\alpha$-FeOOH powder. The resulting powder was dehydrated by heating at 500° C. in a nitrogen stream for two hours to give an acicular $\alpha$-$Fe_2O_3$ powder.

100 g. of thus obtained $\alpha$-$Fe_2O_3$ powder was suspended in 2 l of water, and to the resulting suspension was added with stirring an aqueous sodium silicate solution in a ratio of Si/Fe of 8 atomic %. Stirring was continued for additional one hour, and the resulting slurry was filtered. Thus collected product was washed with water and dried. The resulting Si-coated $\alpha$-$Fe_2O_3$ powder was then reduced in a hydrogen stream at 480° C. for six hours to give a ferromagnetic metal powder.

EXAMPLE 5

The procedure of Example 4 was repeated except that 4% Cu-doped $\alpha$-FeOOH having a length of 0.4 $\mu$m and an acicular ratio of 20 was used as the starting material to give $\alpha$-$Fe_2O_3$ powder and a ferromagnetic metal powder.

EXAMPLE 6

150 g. of the same $\alpha$-FeOOH powder as that used in Example 1 was suspended in 2 l of water, and to the resulting suspension was added with stirring an aqueous sodium silicate solution in a ratio of Si/Fe of 8 atomic %. Stirring was continued for additional one hour, and the resulting slurry was filtered. Thus collected product was washed with water and dried to give a Si-coated $\alpha$-FeOOH powder.

The Si-coated $\alpha$-FeOOH powder was dehydrated by heating at 500° C. in a nitrogen stream for two hours to give acicular $\alpha$-$Fe_2O_3$ powder. 100 g. of this powder was suspended in 2 l of water, and to the resulting suspension was added with stirring an aqueous sodium silicate solution in a ratio of Si/Fe of 8 atomic %. Stirring was continued for additional one hour, and the resulting slurry was filtered. Thus collected product was washed with water and dried to give Si-coated $\alpha$-$Fe_2O_3$ powder.

The resulting Si-coated $\alpha$-$Fe_2O_3$ powder was reduced in a hydrogen stream at 540° C. for sic hours to give the desired ferromagnetic metal powder.

EVALUATION OF FERROMAGNETIC METAL POWDER

The powder characteristics of the sample (ferromagnetic metal powder) obtained in the above-mentioned examples are shown in Table 1. In Table 1, the specific surface area was measured by the nitrogen gas adsorption method, and the magnetic properties were measured by means of a conventional vibrating sample magnetrometer.

TABLE 1

| | Example | | | Comparison Example | | | Example | | |
|---|---|---|---|---|---|---|---|---|---|
| | 1 | 2 | 3 | 1 | 2 | 3 | 4 | 5 | 6 |
| $\alpha$-FeOOH | | | | | | | | | |
| Doped | None | None | None | None | None | None | Ni 5% | Cu 4% | None |

TABLE 1-continued

| | Example | | | Comparison Example | | | Example | | |
|---|---|---|---|---|---|---|---|---|---|
| | 1 | 2 | 3 | 1 | 2 | 3 | 4 | 5 | 6 |
| Metal Treated Si/Fe % | 3.0 | 3.0 | 3.0 | 3.0 | 6.0 | 0 | 8.0 | 8.0 | 8.0 |
| Dehydration Temp. °C. | 350 | 500 | 700 | 850 | 500 | 500 | 500 | 500 | 500 |
| $\alpha$-$Fe_2O_3$ | | | | | | | | | |
| Specific Surface Area $m^2/g$ | 105 | 85 | 73 | 52 | 93 | 68 | 99 | 102 | 94 |
| Treated Si/Fe % | 3.0 | 3.0 | 3.0 | 3.0 | 0 | 6.0 | 8.0 | 8.0 | 8.0 |
| Reduction Temp. °C. | 440 | 440 | 440 | 440 | 440 | 440 | 480 | 480 | 540 |
| Metal Powder | | | | | | | | | |
| Specific Surface Area $m^2/g$ | 58 | 73 | 55 | 32 | 35 | 38 | 75 | 77 | 66 |
| Hc (Oe) | 1350 | 1420 | 1450 | 1370 | 1255 | 1340 | 1470 | 1460 | 1310 |
| $\sigma s$ (emu/g) | 143 | 141 | 144 | 145 | 146 | 146 | 142 | 143 | 138 |

Remark: The treated amount is given as atomic % (Si/Fe).

It is evident from Table 1 that the ferromagnetic metal powder produced by the process of the present invention has a high coercive force (Hc) and a large specific surface area as compared with those produced by conventional methods.

We claim:

1. In a process for producing a ferromagnetic metal powder comprising treating acicular iron oxyhydroxide or an acicular metal oxyhydroxide composed mainly of iron with a silicon compound, dehydrating the treated material by heating the material in a non-reducing atmosphere to produce iron oxide particles or metal oxide particles composed mainly of iron, and reducing the resulting iron oxide particles or metal oxide particles composed mainly of iron by heating in a reducing atmosphere to produce iron powder or a metal powder composed mainly of iron, the improvement in which the dehydration by heating in a non-reducing atmosphere is performed at a temperature of from 300° to 800° C. and the iron oxide particles or the metal oxide particles composed mainly of iron are treated with a silicon compound prior to the reduction by heating in a reducing atmosphere.

2. The process for producing a ferromagnetic metal powder as claimed in claim 1, wherein the dehydration by heating in a non-reducing atmosphere is performed at a temperature of from 400° to 650° C.

3. The process for producing a ferromagnetic metal powder as claimed in claim 1 or 2, wherein the metal composed mainly of iron contains 1 to 20 atomic % of at least one metal selected from nickel and copper and the remainder is substantially iron.

4. The process for producing a ferromagnetic metal powder as claimed in claim 1 or 2, wherein the particle of the acicular iron oxyhydroxide powder has a shape such that the length is from 0.1 to 2 $\mu$m and the acicular ratio is from 2/1 to 50/1.

5. The process for producing a ferromagnetic metal powder as claimed in claim 1 or 2, wherein the amount of the silicon compound employed for the treatment of the acicular iron oxyhydroxide or an acicular metal oxyhydroxide composed mainly of iron is from 0.5 to 15% in terms of Si/Fe atomic ratio.

6. The process for producing a ferromagnetic metal powder as claimed in claim 1 or 2, wherein the amount of the silicon compound employed for the treatment of the iron oxide particles or the metal oxide particles composed mainly of iron is from 0.5 to 15% in terms of Si/Fe atomic ratio.

7. The process for producing a ferromagnetic metal powder as claimed in claim 1 or 2, wherein the reduction by heating in a reducing atmosphere is performed at a temperature of from 300° to 550° C.

* * * * *